US005427735A

United States Patent [19]

Ritter et al.

[11] Patent Number: 5,427,735

[45] Date of Patent: Jun. 27, 1995

[54] SUPERALLOY FOILS BY HOT ISOSTATIC PRESSING

[75] Inventors: Ann M. Ritter, Albany; Melvin R. Jackson, Niskayuna, both of N.Y.

[73] Assignee: General Electric Company, Schenectady, N.Y.

[21] Appl. No.: 194,967

[22] Filed: Feb. 14, 1994

[51] Int. Cl.[6] ..... B22F 3/14

[52] U.S. Cl. ..... 419/47; 419/49

[58] Field of Search ..... 419/47, 49

[56] References Cited

U.S. PATENT DOCUMENTS 4,917,858 4/1990 Eylon et al. ..... 419/28

4,971,757 11/1990 Day et al. ..... 419/23

OTHER PUBLICATIONS

Article—Processing and Properties of Gamma Titanium Aluminide Sheet Produced from PREP Powder, M. A. Ohls et al, —Nuclear Metals, Inc. (1991)-pp. 289-296.

German, Randall M., "Liquid Phase Sintering", Plenum Press, 1985, pp. 1-8, 157-164.

Klar, Erhard, "Powder Metallurgy", Am. Soc. for Metals, 1983, pp. 248-279.

*Primary Examiner*—Donald P. Walsh

*Assistant Examiner*—Daniel Jenkins

*Attorney, Agent, or Firm*—James Magee, Jr.

[57] ABSTRACT

Dense superalloy foils are prepared by hot isostatically pressing a mixture of low melting alloy powders and high melting alloy powders at a temperature at least equal to or greater than three-quarters of the melting point of the low melting point alloy powder and below the melting point of the high melting point alloy powder, at a pressure of at least 10 thousand pounds per square inch for about one to five hours.

3 Claims, No Drawings

SUPERALLOY FOILS BY HOT ISOSTATIC PRESSING

FIELD OF THE INVENTION

The present invention relates to a method of forming superalloy foils by hot isostatic pressing. More specifically, it relates to hot isostatic pressing a mixture of metal alloy powders having different compositions into a full density foil.

BACKGROUND OF THE INVENTION

Foil, as defined in *A Concise Encyclopedia of Metallurgy*, by A. D. Merriman, MacDonald and Evans LTD. 1965, is a very thin sheet metal with no standard thickness, but it is generally regarded as being intermediate in thickness between "leaf" and sheet. *A Glossary of Metallurgical Terms and Engineering Tables*, published by The American Society for Metals, in 1983, lists a definition for foil as "a metal in sheet form less than 0.15 mm (0.006 inches) in thickness." As used herein, the term "foil" designates a thin layer of metal having a thickness range of about 0.005–0.017 inches.

A process for making foils is disclosed in U.S. Pat. No. 4,917,858. U.S. Pat. No. 4,917,858 teaches blending a powder of titanium with a powder of aluminum in preselected proportions and rolling the mixed powders to a predetermined thickness to form a foil of a titanium-aluminum alloy and then sintering the rolled foil followed by hot pressing the foil to densify the foil to near theoretical density. U.S. Pat. No. 4,917,858 also discloses the incorporation of a third metal powder as an alloying element. Niobium, molybdenum, vanadium, chromium, manganese, erbium, and yttrium are listed as candidate third powder additives. The drawback of this method is that several intermediate steps, such as rolling, vacuum sintering, and pressing, must be carried out in order to obtain thin foils. Further, U.S. Pat. No. 4,917,858 is limited to utilizing powders of single elements and their alloys to form a foil.

Therefore, it is desirable to provide a method for making foils compatible with a variety of prealloyed compositions, preferably in powder form, and particularly with admixtures of prealloyed powders having different physical properties (e.g. different melting points and softening points), which provides greater improvement of alloy composition, thereby allowing low ductility alloy foils to be manufactured.

Additionally, it is desirable to provide alloy foils that can be utilized in repair and joining operations.

SUMMARY OF THE INVENTION

The present invention provides a method for preparing a superalloy foil comprising at least two alloy compositions having different melting points or softening points. Herein, low melting point alloy is referred to as low melting powder or low melting particles. High melting point alloy is referred to as high melting powder or high melting particles.

The invention comprises a method for producing a foil comprising the steps of admixing a low melting powder and a high melting powder; and hot isostatic pressing the admixture at a temperature of at least equal to or greater than three-quarters of the melting point of the low melting point metal powder and below the melting point of the high melting point metal powder, at a pressure of at least 10 thousand pounds per square inch, herein ksi, for a period of time sufficient to form a foil having a workable density and about 0.008 inches to about 0.017 inches thick.

Hot isostatic pressing is defined in *Metals Handbook*, 9th Edition, Vol. 7, p. 419, as a "materials processing technique in which high isostatic pressure is applied to a powder part or compact at elevated temperatures to produce particle bonding. This process usually results in the manufacture of a fully dense body, although partially dense bodies also can be intentionally produced. During processing, the compact is subjected to equal pressure from every side."

Plastic deformation of the low melting point powder during hot isostatic pressing allows the low melting particles to soften and squeeze between the high melting particles, thereby forming a matrix-particle composite, strengthened by bonding mechanisms, which can be mechanical or diffusional in character. During hot isostatic pressing, some interdiffusion of elements occurs between the high melting powder and low melting powder.

After hot isostatic pressing, the cans are etched away from the foil. An example of an etchant is a solution of 50% nitric acid-50% water. The average thickness of the foils is about 0.012 inches to about 0.013 inches, with a range of thickness of about 0.008 inches to about 0.017 inches. The foils have a minimum workable density of about 80 to about 95 percent theoretical density.

It is therefore an object of this invention to provide a method for making an alloy foil comprising low and high melting powders that can be used to repair or join superalloy structures. This would include low ductility alloys, which are otherwise unfabricable.

It is also an object of this invention to provide a one step process of making superalloy foils that is a simpler, faster, and more economical method of making foils.

DETAILED DESCRIPTION OF THE INVENTION

It has been found that mixtures of metal powders having varying compositions and different melting or softening points can be hot isostatically pressed directly into metal foils. Such foils can be used to join compatible metal surfaces by application of heat and pressure.

In the execution of this technique, one or more of the powder compositions is such that it has a relatively low melting point. This allows the foil to be hot isostatically pressed at or around the low melting point of this constituent. The rest of the powder in the mixture may be of one composition, or more than one, depending on the final desired chemistry of the foil. This powder may have a high melting temperature.

Foils made by this combination of low melting and high melting powders are herein referred to as reactive foils. The term "reactive foils" means foils formed by the reaction of low melting powders and high melting powders.

After hot isostatic pressing at a low temperature, the reactive foil can be subjected to a high temperature processing step that ultimately results in homogenization of the foil.

Alternatively, the low melt powder and high melt powder may have compositions such that homogenization of these powders results in a chemistry that is very brittle, such as an intermetallic. In such a case, when the alloys form a brittle foil that cannot be heat treated to homogenize, hot isostatic pressing of the powder mixture may be done at a temperature such that melting of the low melting powder and homogenization of the powders occurs during the hot isostatic pressing step. The hot isostatic pressing temperature would still be below the melting point of the high melting powder.

The low melting powder and high melting powder can be prepared by conventional powder making processes known in the art, such as gas atomization techniques or mechanical alloying. It is preferred that the powders have a generally spherical shape.

The low melting powder and high melting powder used to form the dense foil of the instant invention can have a particle size in the range of about 50 microns to about 150 microns. The particle size influences the flowability of the powder during loading of the can. In comparison to the high melting particle, the low melting particle is less than or equal to the high melting particle size. This is so that the low melting particles will distribute as a network between the high melting particles.

Powders should be well mixed prior to loading into the hot isostatic pressing can. This is accomplished by pouring the powders into a glass jar and rotating the jar for about thirty minutes on a set of rollers. Other suitable means of mixing the low and high melting powders can be utilized.

The volume percent of the low melting powder mixed with the high melting powder is about ten to about 50 percent. The percent selected is based on the desired composition of the reactive foil and its later application.

Subsequent to blending the high melting and low melting powders, the mixture is loaded into a can. The functional requirements of the can include control of shape and dimension prior to and during processing; maintenance of leak tightness against low and high pressure during evacuation, sealing, and densification; noncontamination of powder; and minimal interaction with powder by diffusion processes during the hot isostatic pressing cycle.

During loading of the can with a mixture of high and low melting powders, the can is vibrated ultrasonically to facilitate even packing of the powder. The packing density of the powder mixture in the can is about sixty to about sixty-five percent. Powder packing density is defined as the ratio of apparent density of settled powder to 100% dense material.

After the can loading step, hot isostatic pressing, sometimes referred to as HIPing, of the sealed can takes place.

Suitable temperatures, for the practice of this invention, range from about 480° C. for low melting powders, such as aluminum or aluminum alloys, to about 1700° C. for high melting powders, such as tungsten or tungsten alloys. In the practice of this invention, the temperature applied during hot isostatic pressing is dependent on the low melting powder composition. Generally speaking, the temperature-selected is equal to or greater than about three-quarters of the melting point of the low melting powder.

In some alloy systems, a temperature may be selected so that the low melting powder softens during processing, without becoming completely molten. The resultant foil contains a high melting phase and a re-meltable low melting phase.

In other alloy systems, a higher temperature for processing may be chosen, depending on the desired microstructure of the reactive foil. At higher temperatures, the foil has a homogeneous structure containing intermetallic phase particles. The higher temperature during hot isostatic pressing is always below the melting point of the high melting powder.

In this invention, applied pressures are equal to or greater than about 10 ksi, with 15 ksi being an overall average pressure utilized. It is to be understood that the pressure and temperature are increased simultaneously during the hot isostatic pressing process. The hot isostatic pressing time is typically about four hours, and can be varied between about one and five hours.

After the completion of hot isostatic pressing, the reactive foil is removed from the can by chemical etching. Etchants are chosen so as not to attack the reactive foil. The instant invention utilizes a solution of 50% nitric acid and 50% water as an etchant when the reactive foil is a nickel-based superalloy.

Examples 1-3 illustrate the invention.

Three reactive foils of nickel-base superalloys were made using mixtures of metal powders. Each foil utilized four different metal powder alloys in its composition. The metal powder alloys were selected from the following powders, given in weight percent:

POWDER A: Ni—7.5Co—9.2Cr—1.5Mo—6.0W—4.0Ta—3.7Al—4.2Ti—0.5Nb

POWDER B: Ni—20Cr

POWDER C: Ni—60Al—1B

POWDER D: Ni—36Ti—1B

POWDER E: Al—11.6Si

The sizes of powders A-E are given in Table 1. Powder size fractions were not optimized for powder flowability, but represent what was available for those compositions. Of these, the Ni—60Al—1B, the Ni—36Ti—1B, and the Al—11.6Si were low melts.

TABLE 1

| POWDER | MESH SIZE | MICRONS |
|---|---|---|
| A | +170 | >88 |
| B | −140 + 270 | 53–105 |
| C | −120 + 325 | 44–125 |
| D | −20 | <841 |
| E | −140 + 325 | 44–105 |

Table 2 gives the powder mixtures and their volume fractions for reactive foils 1-3.

TABLE 2

| POWDER MIXTURES FOR REACTIVE FOILS | | | | | |
|---|---|---|---|---|---|
| Foil No. | A | B | C | D | E |
| FOIL 1 | 85 wt/o | 5 wt/o | 5 wt/o | 5 wt/o | — |
| FOIL 1 | 80 vol/o | 4 vol/o | 10 vol/o | 6 vol/o | — |
| FOIL 2 | 60 wt/o | 5 wt/o | 20 wt/o | 15 wt/o | — |
| FOIL 2 | 48 vol/o | 4 vol/o | 33 vol/o | 15 vol/o | — |
| FOIL 3 | 80 wt/o | 5 wt/o | — | 5 wt/o | 10 wt/o |
| FOIL 3 | 66 vol/o | 4 vol/o | — | 5 vol/o | 25 vol/o |

The powders were well mixed in a glass jar by rotating for 30 minutes, and then loaded into a hot isostatic pressing can. The can was vibrated ultrasonically during powder loading, to facilitate even packing of the powder. Hot isostatic pressing was carried out under argon at 15 ksi and 875° C. for four hours. Temperature and pressure were increased simultaneously during hot isostatic pressing. The foils were removed from the cans by etching in a solution of 50% nitric acid-50% water. The average thickness of the foils was 0.012–0.013 inches, with a range in thickness of 0.008–0.017 inches.

Examination of the foils using an optical microscope shows that the unmelted powder, POWDER A and POWDER B, were held together in the foil by a network of low-melting powder, which had melted during the hot isostatic pressing process. There was little or no deformation of POWDER A and POWDER B, as would be expected at the low hot isostatic pressing temperature. There was very little porosity in the foils, and fairly extensive diffusion interaction between the unmelted powders, A and B, and the molten powders, C, D, and E.

What is claimed is:

1. A method for producing a superalloy foil comprising at least two alloy compositions having different melting points or softening points by hot isostatic pressing, comprising the steps of:

(a) admixing at least one low melting point powder selected from the group consisting essentially of aluminum based alloys and nickel based alloys having a melting point at least about 480° C., where said low melting alloy powder is about ten to fifty volume percent, and a high melting point alloy powder having a melting point greater than said low melting point alloy powder; and (b) hot isostatic pressing the admixture at a temperature of at least equal to or greater than three-quarters of the melting point of the low melting point alloy powder, at a pressure of at least 10 thousand pounds per square inch for about a period of time sufficient to provide a foil having a workable density of about 80 to 95 percent theoretical density and about 0.008 inches to about 0.017 inches thick.

2. The method of claim 1 wherein said low melting point powder and said high melting point powder have a particle size in the range of about 50 microns to about 150 microns.

3. The method of claim 2 wherein the particle size of said low melting point powder is less than or equal to the high melting point particle size.

* * * * *